US006161275A

United States Patent [19]

Moss et al.

[11] Patent Number: 6,161,275

[45] Date of Patent: Dec. 19, 2000

[54] METHOD OF MANUFACTURING COMMUTATORS FOR ELECTRIC MOTORS

[75] Inventors: Graham D. Moss, Dutton; Scott Campbell, London, both of Canada

[73] Assignee: Siemens Canada Limited, Mississauga, Canada

[21] Appl. No.: 09/112,113

[22] Filed: Jul. 8, 1998

[51] Int. Cl.[7] ..... H01R 43/06

[52] U.S. Cl. ..... 29/597; 310/43; 310/237

[58] Field of Search ..... 29/597, 598; 310/233, 310/235, 237, 43

[56] References Cited

U.S. PATENT DOCUMENTS

| | | | |
|---|---|---|---|
| 1,410,914 | 3/1922 | Hartzell | 29/597 |
| 2,999,956 | 9/1961 | Faulhaber | 310/235 |
| 3,010,182 | 11/1961 | Quinlan | 29/155.54 |
| 3,314,132 | 4/1967 | Van Dorn | 29/155.54 |
| 3,486,056 | 12/1969 | Vuillemot | 310/228 |
| 3,487,249 | 12/1969 | Nicholls et al. | 310/234 |
| 3,521,101 | 7/1970 | Arora | 310/233 |
| 3,562,570 | 2/1971 | Frank | 310/234 |
| 3,668,449 | 6/1972 | King | 310/236 |
| 3,819,964 | 6/1974 | Noodleman | 310/46 |
| 3,819,967 | 6/1974 | Binder | 310/236 |
| 3,861,027 | 1/1975 | Allen | 29/597 |
| 3,864,821 | 2/1975 | Ito et al. | 29/597 |
| 3,892,987 | 7/1975 | Noodleman | 310/46 |
| 4,088,914 | 5/1978 | Aoki | 310/264 |
| 4,286,375 | 9/1981 | Nakamura et al. | 29/597 |
| 4,349,759 | 9/1982 | Arnold et al. | 310/233 |
| 4,481,439 | 11/1984 | Stokes | 310/233 |
| 4,663,834 | 5/1987 | Stokes | 29/597 |
| 4,769,566 | 9/1988 | Matsuda | 310/40 MM |
| 4,890,026 | 12/1989 | Isozumi | 310/233 |
| 4,910,790 | 3/1990 | Kershaw | 388/836 |
| 5,095,611 | 3/1992 | Smith | 29/596 |
| 5,149,999 | 9/1992 | Abo et al. | 310/239 |
| 5,157,299 | 10/1992 | Gerlach | 310/237 |
| 5,164,623 | 11/1992 | Shkondin | 310/678 |
| 5,373,209 | 12/1994 | Strobl et al. | 310/234 |
| 5,434,463 | 7/1995 | Horski | 310/248 |
| 5,442,849 | 8/1995 | Strobl | 29/597 |
| 5,552,652 | 9/1996 | Shimoyama et al. | 310/237 |
| 5,734,218 | 3/1998 | Crockett et al. | 310/232 |

*Primary Examiner*—Carl E. Hall

[57] ABSTRACT

A method for manufacturing a commutator adapted to be mounted on a shaft of an electric motor for cooperation with electrical contacts of the motor, wherein a support member is molded from an electrically insulating material, the support member having a major outer surface portion divided into subsections of lesser area by a plurality of rib members extending upwardly from the outer surface portion. A sheet of electrically conductive material with minimum waste, is cut into commutator segments of predetermined shape and dimensions preferably by a stamping process for attachment to the outer surface portions of the subsections. The commutator segments are then adhesively attached to the outer surface portions of the subsections such that the segments form commutator surfaces interrupted by the rib members, with the upper surface of each segment being slightly higher than the upper surface of each of the adjacent rib members.

9 Claims, 3 Drawing Sheets

METHOD OF MANUFACTURING COMMUTATORS FOR ELECTRIC MOTORS

BACKGROUND OF THE INVENTION

1. Field of the Invention

This invention relates to face and barrel-type commutators for electric motors and a method of manufacturing such commutators.

2. Description of Related Art

Electric motors and their construction are generally well known. U.S. Pat. No. 5,434,463 relates to a representative direct current motor which utilizes a commutator in combination with crescent shaped brushes. The disclosure of U.S. Pat. No. 5,434,463 is incorporated herein by reference.

U.S. Pat. No. 5,095,611 relates to a method of assembling an electric motor to eliminate a separate end play adjustment wherein permanent magnets act on the armature laminations to urge the motor shaft in one direction so that the entire end play appears at only one end of the shaft. The disclosure of U.S. Pat. No. 5,095,611 is incorporated herein by reference.

Commonly assigned, concurrently filed application entitled Combined Armature and Structurally Supportive Commutator for Electric Motors, the disclosure of which is incorporated herein by reference, is directed to a novel combined armature and structurally supportive commutator wherein all rotational torque is transmitted from the armature to the commutator and to the rotor shaft. Commonly assigned, concurrently filed application entitled Commutator for Two Speed Electric Motor and Motor Incorporating Same, the disclosure which is incorporated herein by reference, is directed to a novel commutator for use in two speed motors, which minimizes the axial space utilized by the commutator.

The manufacture of commutators for such electric motors according to presently known methods generally involves directing a copper strip through a multislide to form a copper shell with notching and skiving processes provided or in existing flat commutators, through progressive die forming. The formed shell is then transferred to a molding operation for the purpose of manufacturing the supporting body by molding phenolic material directly to the shell. Thereafter certain secondary operations are performed, as for example, to produce slots in the shell following the molding and post curing procedures to bake the commutator.

Bar separation processes typically utilize a saw cut operation which inevitably leaves metal particulates in the slots thus created, thereby requiring brushing of the slots to remove the metal particulates. Furthermore, the step of molding phenolic material directly to the shell inevitably leaves residues of phenolic material on the tangs of the commutator which generally requires further brushing operations to clean the surfaces such that they may be suitable for fusing processes during the manufacture of the final motor product.

U.S. Pat. No. 4,481,439 relates to a molded commutator made up of segments arranged in a ring with their brush contact surfaces facing inwardly and forming a cylindrical shape. A matrix of plastic is molded between and around the outside of the segment ring in order to separate the segments electrically and to hold them in the ring configuration.

U.S. Pat. No. 4,663,834 relates to a method for making an inverted commutator assembly for mounting on a rotor shaft, comprising forming a plurality of rotatable commutator segments with each segment having a brush contact surface into a ring in which the segments are circumferentially arranged in a spaced-apart relationship about a longitudinal access of rotation, and placing reinforcing means in the form of an outer casing of high tensile strength material around the longitudinal axis of rotation for reinforcing the segments. A matrix of insulating material is molded between the inside of the casing and the outside of the ring of segments and between the segments for electrically isolating the segments. Means for affixing the commutator assembly to a rotatable shaft passing through the longitudinal access of rotation is then attached to the matrix.

U.S. Pat. No. 4,349,759 relates to a commutator for electrical machines and a method of manufacture of the commutator in which the commutator consists of a lamination assembly held together by a pair of shrink-rings. One of the rings serves to support the commutator on a commutator hub and comprises first and second ring portions having between them a decoupling portion. The first ring portion is in the form of a shrink-ring and holds together the lamination assembly. The second ring portion is secured to the commutator hub. The other shrink-ring also holds together the lamination assembly. In the method of manufacture of the commutator, both the first and second ring portions are simultaneously shrunk on to the lamination assembly and commutator hub respectively.

The presently known techniques for manufacturing commutators clearly involve well known manufacturing procedures which are generally time consuming and expensive, particularly in that relatively large sections of the manufacturing material must be processed through numerous steps to produce the final commutator, with consequent excessive loss of material. Such material losses are particularly caused generally by the cutting operations and the operations requiring the removal of materials and therefore generally result in substantially increased costs to manufacture the commutators. The present invention is directed to a unique method for manufacturing commutators for electric motors whereby such intricate and expensive manufacturing operative steps are minimized, with the result that improved commutators are produced at reduced cost for incorporation into electric motors of various types.

BRIEF SUMMARY OF THE INVENTION

The invention relates to a method of manufacturing a commutator adapted to be mounted on a shaft of an electric motor for cooperation with electrically conductive brushes of the motor, which comprises molding a support member from an electrically insulating material, the support member having a major outer surface portion divided into subsections of lesser area by a plurality of rib members extending upwardly from said outer surface portion, cutting a sheet of electrically conductive material into commutator segments of predetermined shape and dimensions for attachment to the outer surface portions of said subsections, and attaching the commutator segments to the outer surface portions of the subsections such that the segments form respective commutator surfaces interrupted by the rib members. The support member has a generally annular disc-like configuration and the major outer surface portion has a generally annular configuration. The rib members extend in a generally radial direction along the major outer surface portion. The rib members have a heightwise dimension above the major outer surface slightly less than the thickness of the commutator segments such that when the commutator segments are attached to the outer surface portions of the support member, the outer surface of the commutator is provided with insulating gaps between adjacent pairs of commutator segments.

According to the method, the support member is molded from a high temperature resinous material, preferably a phenolic resinous material. Further the commutator segments are cut from a suitable copper alloy sheet material and the step of attaching the commutator segments to the outer surface portions of the subsections utilizes adhesive means such a suitable high temperature acrylic adhesive, in which case the thickness of the commutator segments will include the relatively thin layer of adhesive. The commutator segments each further comprise a hook-shaped member extending therefrom and adapted to be connected to armature winding means of the motor. In one embodiment, the hooks extend from one side of the support member to the other side thereof over the outer periphery of the support member. For certain applications, the hooks extend through apertures in the support member.

In another embodiment a method of manufacturing a barrel-type commutator is disclosed wherein the support member has a generally cylindrical configuration and the major outer surface portion is generally cylindrical. In this embodiment, the rib members extend upwardly from the generally cylindrical outer surface portion and have a heightwise dimension slightly less than the thickness of the commutator segments such that when the commutator segments are attached to the outer surface portions of the support member, the respective outer surface of each segment is slightly higher than the upper surface of each adjacent rib member. The support member is molded from a high temperature resinous material such as a phenolic resinous material. Furthermore, in this embodiment, the step of attaching the commutator segments to the outer surface portions of the subsections also utilizes adhesive means such as a high temperature acrylic adhesive as described previously. A hook-shaped member also extends from each segment and is adapted to be connected by fusing or crimping to armature winding means of the motor.

A commutator adapted to be mounted on a rotatable shaft of an electric motor for cooperation with electrically conductive brushes of the motor is also disclosed, which comprises a support member molded from an electrically insulating material, the support member having a major outer surface portion divided into subsections of lesser area by a plurality of upstanding radially extending rib members on the outer surface portion. A plurality of commutator segments of predetermined shape and dimensions are attached to the outer surface portions of the subsections.

The invention also relates to an electric motor which comprises, a housing, a rotor positioned within the housing and including, a rotor shaft rotatably mounted within the housing, an armature core having armature windings wound therearound, and a commutator for directing electric current from a plurality of electrically conductive brushes to the armature windings. The commutator includes a support member molded from an electrically insulating material and having a major outer surface portion divided into subsections of lesser area by a plurality of rib members extending upwardly from the outer surface portion. As described in connection with the commutator, a plurality of commutator segments of predetermined shape and dimensions are attached to the outer surface portions of the subsections, preferably by adhesive means.

BRIEF DESCRIPTION OF THE SEVERAL VIEWS OF THE DRAWINGS

Preferred embodiments of the invention will be described hereinbelow with reference to the drawings, wherein.

DETAILED DESCRIPTION OF THE INVENTION

Figure 1:
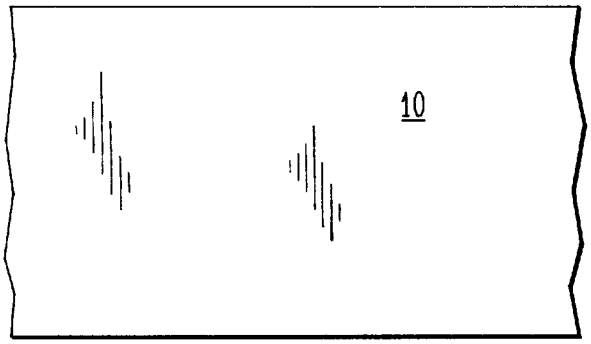
FIG. 1 is a plan view of a section of a sheet of electrically conductive copper alloy material from which conductive segments are stamped for the manufacture of a commutator according to the present invention.
Figure 2:
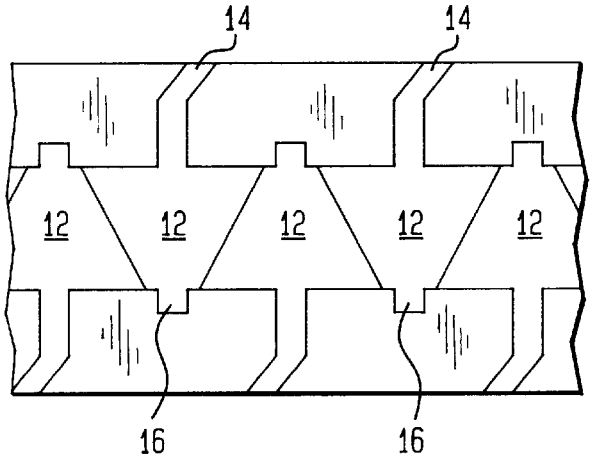
FIG. 2 is a plan view of the section of sheet of material shown in FIG. 1, illustrating appropriate stamping lines which define the commutator segments for production of a single speed disc-type commutator.

Referring initially to FIGS. 1 and 2 there is shown a section 10 of a sheet of copper alloy sheet material from which appropriate conductive commutator segments 12 can be cut or stamped in accordance with the pattern as marked on sheet 10 in FIG. 2. The copper alloy segments are appropriately configured and dimensioned in a manner to minimize waste of copper material as shown in FIG. 2 whereby adjacent segments are defined by common cutting lines and are oriented on the sheet in opposed complementary positions.

Figure 3:
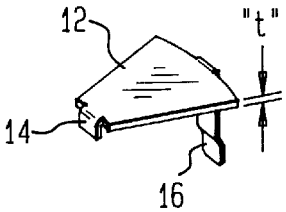
FIG. 3 is a perspective view of an exemplary conductive commutator segment taken from the sheet of FIG. 2 and processed to provide the appropriate bends to form the commutator segment for attachment to a disc-type support structure.

Referring now to FIG. 3 there is shown the exemplary conductive copper alloy segment 12 with the respective tabs 14 and tangs 16. Tabs 14 are locator tabs which serve to locate and retain the copper alloy segments 12 in a radial position on the support member 18 as will be described. Tangs 16 are then bent and shaped to form hooks 16 as shown, to be electrically connected to the armature wires 30 and are configured and dimensioned to be attached to a disc-like molded structural support member 18, shown in FIG. 4.

Figure 4:
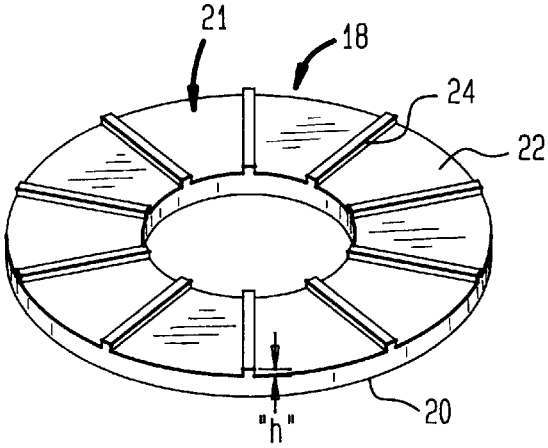
FIG. 4 is a perspective view of a molded disc-like support structure for production of a disc-type commutator according to the method of the present invention.

FIG. 4 shows disc-like structural support member 18, which is molded from a suitable electrically insulating material such as a resinous material, preferably a phenolic resinous material. The phenolic disc 18 is molded as a unitary member having a first annular undersurface 20 which is relatively smooth and continuous, and an upper annular surface 21 having a plurality of upstanding radially extending ridges 24 which define a plurality of adjacent subsections 22 similar in configuration and dimensions to the electrically conductive commutator segments 12 shown in FIG. 3, i.e., shaped as a sector of an annulus.

Figure 5:
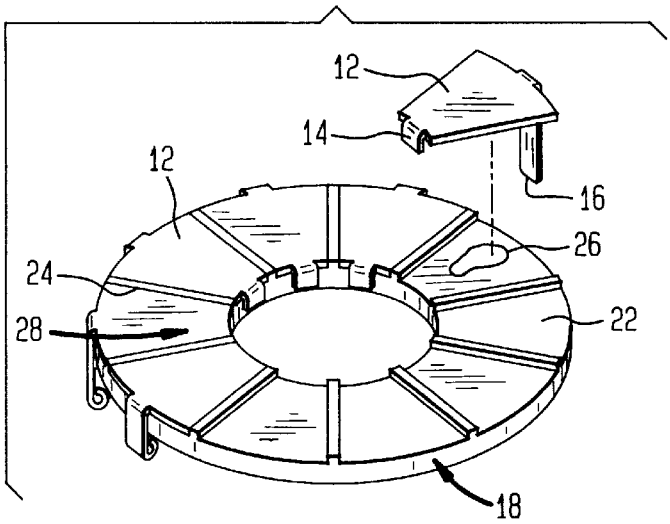
FIG. 5 is a perspective view of the molded disc-like support structure of FIG. 4 illustrating the assembly procedure for production of a commutator according to the invention.

Referring now to FIG. 5, there is illustrated the step of assembling the electrically conductive commutator arc segments 12 with disc-like structural support member 18, utilizing any number of available high temperature structural adhesives 26 for attachment of the commutator segments 12 to the structural support member 18. One example of a high temperature structural adhesive material is a structural acrylic adhesive marketed under number 3273 A/B by Loctite, Corporation, Hartford, Conn.

According to the method of the invention, the commutator arc segments 12 are attached to the disc-like structural support member 18, by first depositing an appropriate amount of adhesive material 26 onto the structural support member 18. The conductive commutator arc segments 12 are then placed in position against the adhesive structural member 18 with the adhesive material therebetween. Thereafter, the adhesive is permitted to cure while the members are held together by a clamp or other suitable means. As noted, alternative adhesives and variations of the sequential steps are contemplated.

It should be noted that the thickness (or height) "h" of the electrically insulating radial rib members 24 shown in FIG. 4 is less than the thickness "t" of the conductive commutator arc segments 12 as shown in FIG. 3, thus creating an insulating gap between adjacent segments. The commutator arc segments 12 are positioned adjacent each radial rib member 24 to provide an upper surface 28 formed by the respective upper surfaces of the individual commutator arc segments 12 and having such insulating gaps between adjacent segments for passage and contact by the brushes of an electric motor in which the disc-like commutator is to be incorporated. It should be noted, however, that the thickness "t" of the segments 12 and the height "h" of rib members 24 should take into consideration the addition of height provided to the segments by the relatively thin layer of adhesive material between the commutator arc segments 12 and structural disc-like support member 18. Preferably the thickness "t" of the segments 12 is about 0.060 inch and the height "h" of the radial rib members 24 is about 0.040 inch, thereby providing discontinuities in the upper surface 28 of about 0.020 inch in depth.

Figure 6A:
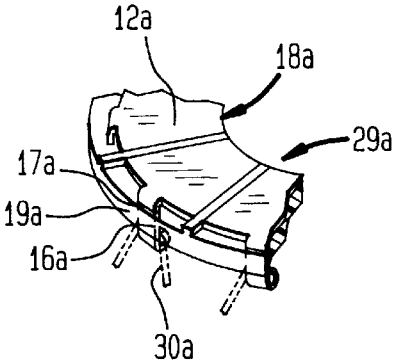
FIG. 6*a* is a perspective view, partially cut away, of another embodiment of the invention, wherein the hooks for connecting armature wires extend through apertures in the support member.
Figure 6B:
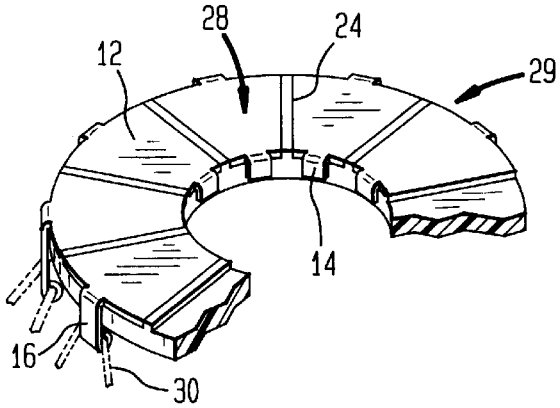
FIG. 6*b* is a perspective view, partially cut away, of the completed disc-type commutator shown partially completed in FIG. 5, illustrating the various layers of distinct materials which form the commutator.

Referring to FIG. 6*b* the completed disc-like commutator 29 is shown with commutator arc segments 12 adhesively attached to the structural support member 18 by the adhesive material 26 shown in FIG. 5. In FIGS. 6*b,* appropriate electrically conductive armature connecting wires 30 are shown fused to hooks 16 for electrical contact with the commutator segments 12. Alternatively the electrical connection may be accomplished by a combination of crimping and fusing techniques after removal of the wire insulation.

In another embodiment shown in FIG. 6*a,* the commutator arc segments 12*a* have a smaller radius than the embodiment of FIG. 6*b,* and the hooks 16*a* extend through apertures 17*a* formed in the structural support member 18*a,* thus leaving the outer peripheral surface 19*a* continuous and smooth, thereby permitting insertion thereof into the central aperture of an armature in interference fitting relation.

Figure 7:
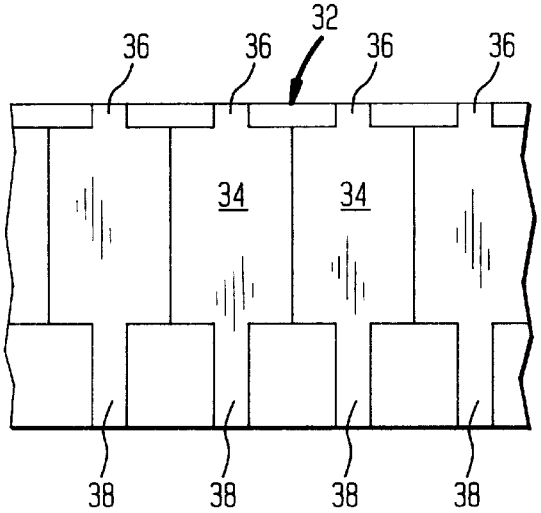
FIG. 7 is a plan view of a section of conductive sheet material similar to FIG. 2, illustrating a marked up layout for stamping conductive commutator segments for use in the production of a barrel-type commutator according to the present invention.
Figure 8:
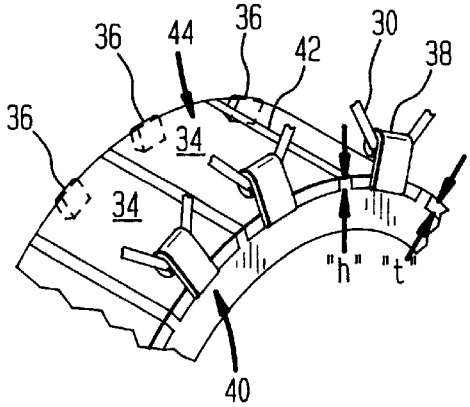
FIG. 8 is a perspective view partially cut away, of a completed barrel-type commutator produced according to the present invention, with portions cut away for convenience of illustration.

Referring now to FIG. 7 there is shown a plan view of a sheet of conductive copper alloy material 32 similar to the sheet of conductive copper material 10 shown in FIGS. 1 and 2. In FIG. 7 the copper sheet 32 is marked for stamping or cutting segments 34 of a type similar to segments 12 shown in the embodiment of FIGS. 1–6, except that segments 34 are configured and dimensioned for attachment to a barrel-type structural support member as shown in FIG. 8. The conductive commutator segments 34 shown in FIG. 7 include attachment tabs 36 at one end similar to the attachment tabs 14 of the segments 12 shown in FIG. 3, and electrical connector tangs 38 at the opposite end similar to the electrical connector tangs 16 shown in FIG. 3.

In the embodiment of FIGS. 7 and 8 barrel-type structural support member 40 is molded of a suitable high temperature resistent electrically insulating material such as a phenolic resinous material similar to the embodiment of FIGS. 1–4, and thereafter the electrically conductive commutator segments 34 are adhesively attached to the barrel-type structural member 40 by a high temperature adhesive in the same manner as shown and described in connection with FIG. 5 with respect to a previous embodiment. Commutator segments 34 include respective tabs 36 and tangs 38 as shown, similar to tabs 14 and tangs 16 of the previous embodiment. Tabs 36 are locator tabs and tangs 38 are bent to form hooks 38 which are utilized to connect armature wires 30 as described previously.

The barrel-type structural support member 40 has a generally cylindrical configuration and includes an outer surface similar to the outer surface 22 of the disc-like structural support member of FIG. 4, with axially extending rib members 42 having a heightwise dimension "h" as shown in FIG. 8 which divide the outer surface of the support member into a plurality of adjacent subsections dimensioned and shaped to receive commutator segments 34. The heightwise dimension "h" shown in FIG. 8 of the axially extending rib members 42 is sufficient to accommodate reception of adjacent commutator segments 34 with a thin layer of adhesive material therebetween as described in connection with the embodiment of FIGS. 1–6, such that the resultant outer surface 44 of the commutator is generally cylindrical in shape and has a plurality of insulating gaps between the segments. Accordingly, the thickness dimension "t" of segments 34 combined with the thin adhesive layer should be slightly greater than the dimension "h" of rib members 42. The dimension "t" may be controlled to accommodate the thickness of the adhesive layer between segments 34 and structural support member 40 in order to provide insulating gaps of predetermined dimensions between segments 34. Thus, outer commutator surface 44 will facilitate repeated electrically interrupted passage thereover of electrically conductive brushes which form part of an electric motor in which the commutator may be incorporated for conducting electricity to and from the armature of the motor in accordance with well known principals of electric motor operation.

Figure 9:
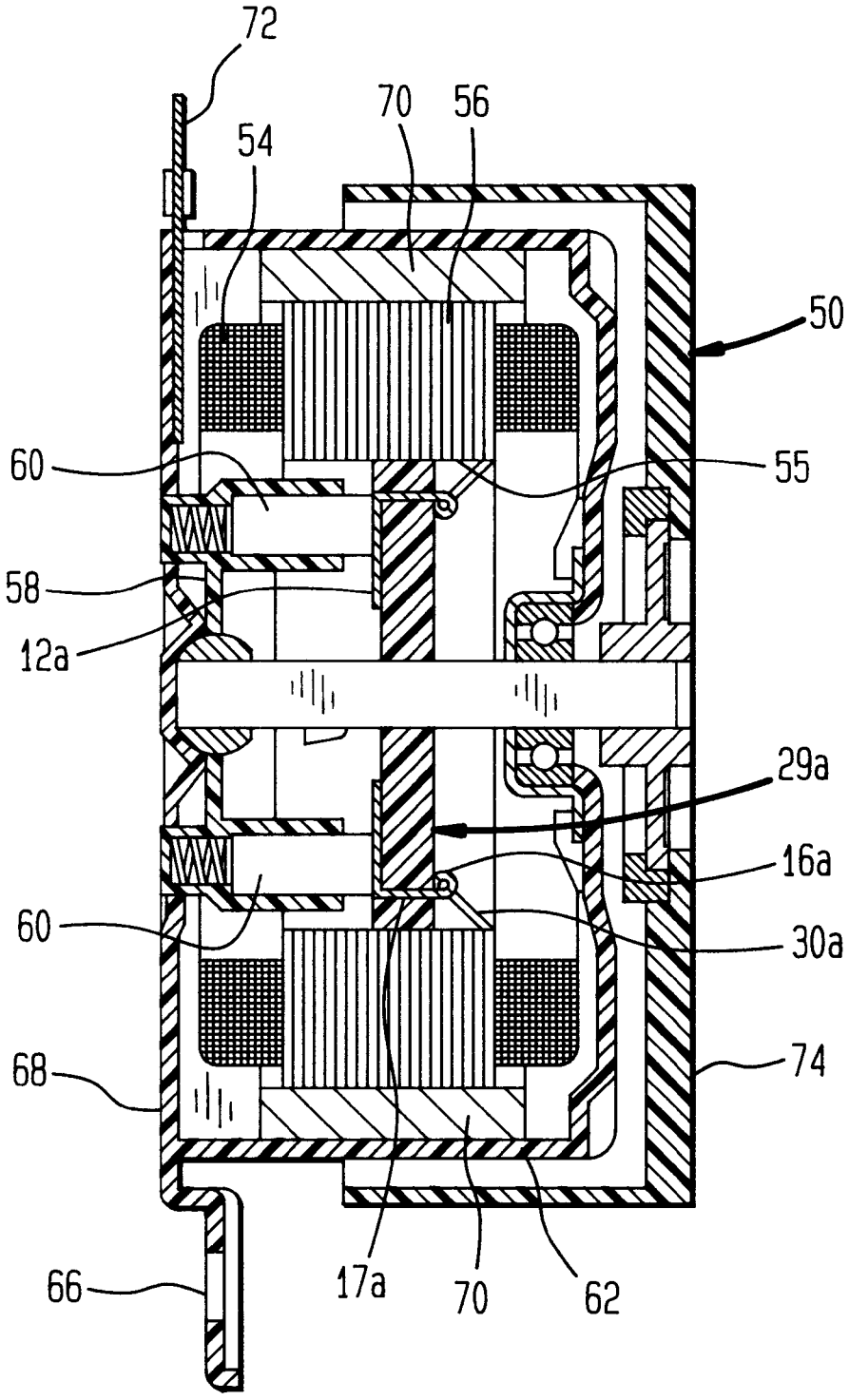
FIG. 9 is a cross-sectional view of a motor incorporating a commutator of the type shown in FIG. 6*a*.

Referring to FIG. 9, a cross-section of a motor 50 is shown which incorporates a commutator of the type shown in FIG. 6*a.* The motor 50 includes a commutator 29*a* which is positioned within the central opening 55 of armature core 56, having armature windings 54 wound therearound. Brush card 58 includes brushes 60 positioned to engage the commutator segments 12*a* to conduct electrical current to the segments and thereafter to the armature windings 54 by known wiring techniques. As noted, commutator 29*a* is of the type shown in FIG. 6*a,* with hooks 16*a* extending through apertures 17*a* in phenolic body 18*a* of the commutator to permit the outermost peripheral surface of the commutator to fit snugly, preferably by interference fit, within the central opening 55 of the armature core 56.

Phenolic resinous housing 62 is provided with a flux ring and a plurality of permanent magnets 70 about the inner periphery. Alternatively, the housing may be made of a ferromagnetic material such as steel. Bracket 66 is an integral part of rear cover plate 68 and is one of three brackets spaced equally around the motor, which are intended to attach the motor to a shroud or other support. Buss bars 72 are connected to rear cover plate 68 for wiring to brushes 60 of brush card 58. Fan hub 74 is preferably formed of a molded resinous material.

It can be appreciated that according to the method of the invention, the commutator segments are readily cut with reduced waste of conductive sheet material, while relatively costly notching, skiving and other manufacturing processes are avoided. In particular, the shortened process flow increases through put and reduces work in progress costs during manufacture. Also, the elimination of saw cutting in stamped bars provides for cleaner slot characteristics—or no conductive gaps—in the commutator. Finally, the molding of a suitable core with bar pockets permits consistent tolerance levels for the bar surfaces.

Furthermore, it can be readily appreciated that the numerous modifications of embodiments of the commutators shown in FIGS. 1–8 and the method of manufacturing such commutators can be made, such as by altering dimensions and configurations, for example, which will become readily obvious to persons skilled in the art, without departing from the scope of the invention.

What is claimed is:

1. A method of manufacturing a Commutator adapted to be mounted on a shaft of an electric motor for cooperation with electrically conductive brushes of the motor, which comprises:

a) molding a support member from an electrically insulating material, said support member having a substantially planar major outer surface portion divided into sub-sections of lesser area by a plurality of rib members extending upwardly from said outer surface portion, each sub-section defining a continuous, substantially planar surface between rib members;

b) cutting a sheet of electrically conductive material into commutator segments of predetermined shape and dimensions for attachment to said planar surfaces of said subsections; and thereafter c) attaching said commutator segments to said planar surfaces of said subsections such that said segments form respective commutator surfaces interrupted by said rib members, wherein said rib members have a heightwise dimension less than the thickness of said commutator segments such that when said commutator segments are attached to said planar surfaces of said support member, the respective upper surface of each segment is discontinuous with said respective upper surface of each adjacent rib member.

2. The method of manufacturing a commutator according to claim 1, wherein said support member has a generally annular configuration and said major outer surface portion has a generally annular configuration, said rib members extending in a generally radial direction along said major outer surface portion.

3. The method of manufacturing a commutator according to claim 2, wherein said rib members have a heightwise dimension less than the thickness of said commutator segments such that when said commutator segments are attached to said outer surface portions of said support member, the respective upper surface of each segment is discontinuous with said respective upper surface of each adjacent rib member.

4. The method of manufacturing a commutator according to claim 1, wherein said support member is molded from a high temperature resinous material.

5. The method of manufacturing a commutator according to claim 4, wherein said resinous material is a phenolic resinous material.

6. The method of manufacturing a commutator according to claim 1, wherein said commutator segments are cut from copper sheet material and the step of attaching said commutator segments to said planar surfaces of said subsections utilizes adhesive means.

7. The method of manufacturing a commutator according to claim 6, wherein said adhesive means comprises an acrylic adhesive.

8. The method of manufacturing a commutator according to claim 1, wherein each said commutator segments comprises a hook-shaped member extending therefrom and adapted to be connected to armature winding means of the motor.

9. A method for manufacturing a face commutator adapted to be mounted on a rotatable shaft of an electric motor for cooperation with electrically conductive brushes of the motor, comprising:

a) molding a support member from an electrically insulating material, said support member having a generally annular configuration and a major annular outer surface portion, said support member defining a central opening for receiving the shaft of the motor, and having an outer radius and a plurality of radially extending rib members extending along said major, substantially planar and annular outer surface portion from said central opening toward said outer radius, said rib members each having an upper surface a predetermined height dimension extending above said outer surface portion to thereby divide said major outer surface portion into a plurality of minor surface portions of lesser area than said major outer surface portion, each minor surface portion defining a continuous, substantially planar surface between rib members;

b) cutting segments of predetermined shape and dimensions from a sheet of copper alloy material to form electrically conductive commutator segments each having an upper surface, including portions to form connective hooks for said segments, said sheet of copper alloy material having a thickness greater than the height of said radially extending rib members of said support member; and thereafter c) adhesively attaching said commutator segments to said planar surfaces of said minor surface portions of said support member, each segment being positioned between adjacent radially extending rib members to thereby form a commutator having a generally discontinuous upper surface having a plurality of conductive portions interrupted by a corresponding plurality of said electrically insulating radially extending rib members for brush contact therewith, said upper surface of each said rib member being lower than said upper surface of each said commutator segments.

* * * * *